US005458207A

United States Patent [19]

Mattero

[11] Patent Number: 5,458,207

[45] Date of Patent: Oct. 17, 1995

[54] METHOD AND AN EQUIPMENT FOR ADJUSTING ROCK DRILLING

[75] Inventor: Unto Mattero, Helsinki, Finland

[73] Assignee: Tamrock Oy, Tampere, Finland

[21] Appl. No.: 133,130

[22] PCT Filed: Apr. 21, 1992

[86] PCT No.: PCT/FI92/00116

§ 371 Date: Oct. 13, 1993

§ 102(e) Date: Oct. 13, 1993

[87] PCT Pub. No.: WO92/19841

PCT Pub. Date: Nov. 12, 1992

[30] Foreign Application Priority Data

Apr. 25, 1991 [FI] Finland ..... 912010

[51] Int. Cl.[6] ..... E21B 3/02

[52] U.S. Cl. ..... 175/27; 175/114; 173/6; 73/151.5

[58] Field of Search ..... 175/27, 26, 24, 175/40, 114; 73/151.5; 173/6

[56] References Cited

U.S. PATENT DOCUMENTS

| | | | |
|---|---|---|---|
| 3,872,932 | 3/1975 | Gosselin | 173/1 |
| 3,971,449 | 7/1976 | Nylund et al. | 175/27 |
| 4,165,789 | 8/1979 | Rogers | 175/27 |
| 4,195,699 | 4/1980 | Rogers et al. | 175/27 |
| 4,793,421 | 12/1988 | Jasinki | 173/6 X |
| 5,129,464 | 7/1992 | Richier | 175/27 X |

FOREIGN PATENT DOCUMENTS 0112810 7/1984 European Pat. Off. .

*Primary Examiner*—Terry Lee Melius
*Attorney, Agent, or Firm*—Nixon & Vanderhye

[57] ABSTRACT

A method for optimizing rock drilling, wherein the drilling is adjusted by means of one or more adjustable parameters such as the feed rate and the rotation rate. In the method, a set value ($H_s$) of each adjustable parameter is deviated in accordance with a sinusoidal curve while integrating a change caused by the deviation in the penetration rate ($\dot{x}$) and adding it to the set value ($H_s$) so that the set value ($H_s$) shifts closer to an optimum penetration rate ($\dot{x}_{opt}$).

9 Claims, 3 Drawing Sheets

METHOD AND AN EQUIPMENT FOR ADJUSTING ROCK DRILLING

The invention relates to a method for optimizing rock drilling, wherein a penetration rate of a drill bit of a drilling machine into a rock is measured and the operating parameters of a drilling equipment are adjusted to maximize the penetration rate.

The invention also relates to an equipment for realizing the method described above, comprising control devices for giving set values to a percussion apparatus of a rock drilling equipment, a rotation rate of a drill bit and a feed force, and means for measuring a penetration rate of the drill bit.

As is well known, the adjustment of a rock drilling machine is based on set values and limits determined by the operator, who sets the percussion power, the rotation power and the feed on the basis of his experience so as to optimize the drilling result. This procedure is poor and it often results in equipment damages or inferior drilling results.

European Patent Specification 112 810 discloses a method in which the percussion rate and percussion frequency of a percussion hammer is measured and varied until the maximum penetration rate is achieved. The frequency and percussion rate are varied so that the percussion power remains substantially constant all the time. A disadvantage of the method is that one attempts to maximize the penetration rate by means of the percussion frequency and the percussion rate, which, in practice, are interdependent control parameters. In practice, the method can thus be regarded as an adjustment based on a single parameter. Moreover, in this method, a change does not affect the momentary value of the penetration rate, if the measurement of the penetration rate is disturbed in some way, and so the method is unreliable to a certain extent and cannot optimize the drill penetration with sufficient accuracy.

The object of the present invention is to provide a method for adjusting a drilling process, which optimizes the penetration rate as efficiently and reliably as possible irrespective of any disturbances affecting the measuring result. The method according to the invention is characterized in that the operating parameters are adjusted one at a time while the other operating parameters are kept substantially constant, that a continuous deviation is caused to occur symmetrically on both sides of the set value of the operating parameter to be adjusted, that a change caused by the deviation in the penetration rate is measured, that when the change caused by the deviation in the penetration rate is different on different sides of the set value, the set value is adjusted on the basis of the measurements in a direction in which the penetration rate increases, and that when a maximum value of the penetration rate is substantially achieved by adjusting one operating parameter, the operating parameter to be adjusted is changed. The equipment according to the invention is characterized in that the control devices comprise automatically operated adjusting means which deviate one operating parameter at a time from its set value, measure variation in the penetration rate, and shift the deviated set value in a direction in which the penetration rate increases, said adjusting means changing the operating parameter to be deviated when the set value being adjusted reaches a value substantially corresponding to a maximum penetration rate.

The basic idea of the invention is that the operating parameters are monitored one at a time by subjecting each parameter to a continuous, regular deviation occurring reciprocally and symmetrically, so that it can be seen on which side of the set value the penetration rate increases, and so the value of the parameter can be shifted towards a greater penetration rate on the basis of the deviation of the parameter. After one parameter is settled to its maximum value, a deviation is caused in the next parameter, and this is continued from one parameter to another in a predetermined circulating order so that the penetration rate of the drill bit is maximized, and the maximum value of the penetration rate can be achieved automatically as the conditions change without any procedures carried out by the operator.

The invention is described in more detail by means of the attached drawings, in which FIG. 1 is a graphic representation of the adjusting method according to the invention when realized with respect to one adjustable parameter;

FIGS. 2*a* to 2*c* illustrate the adjusting method according to the invention graphically;

Figure 1:
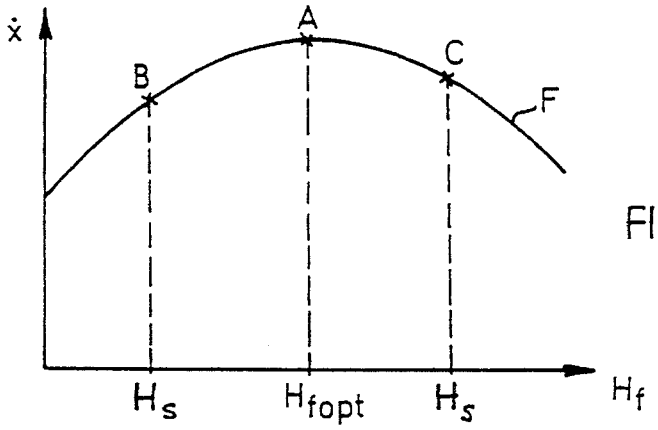

FIG. 1 is a graphic representation of the adjusting method according to the invention realized with respect to one adjustable parameter $H_f$. A penetration rate x is represented by a curve F which forms a convex pattern in the coordinate system $\dot{x}$–$H_f$. When the other operating parameters are constant, the penetration rate reaches its optimum at a point A, which is the highest point of the curve F. In normal conditions, it is to be expected that the position of the point A is not actually known, because the drilling conditions vary, and so the shape of the curve F, for instance, may change momentarily so that the position of the point A on the axis $H_f$ changes. It is, however, possible to aim at achieving the optimal point $H_{fopt}$ momentarily on the curve F by applying the method of the invention. Essential is that there is a set value $H_s$ for the operating parameters of the feed rate, for instance, on the basis of which value the adjustment equipment adjusts the drilling so that the feed rate corresponds to the set value $H_s$. As the optimum value $H_{fopt}$ corresponding to the highest penetration rate on the axis $H_f$ is not actually known, the value of the set value $H_s$ has to be estimated so that it may be set to a point B on the curve F, for instance. In this case, the set value and the optimum value $H_{fopt}$ differ from each other, and the drilling is not as efficient as possible. According to the basic idea of the invention, the set value $H_s$ is now deviated by a small sinusoidal oscillation from its nominal value to the same extent on its both sides, while measuring the magnitude of variation in the penetration rate. In the case of the point B, the penetration rate thereby increases with the set value $H_s$ and correspondingly decreases with the set value $H_s$. As a result of this measurement, the set value $H_s$ is shifted by means of the adjusting equipment in a direction in which the penetration rate increases, until the value $H_{fopt}$ corresponding to the current drilling conditions is achieved. Similarly, if the set value $H_s$ results in the situation represented by a point C, a decrease in the set value $H_s$ indicates an increase in the penetration rate, and an increase in the set value indicates a decrease in the penetration rate. The adjusting equipment shifts the set value $H_s$ so that its value decreases until the penetration rate $H_{fopt}$ optimal in the current conditions is achieved.

Figures 2A, 2B, 2C:
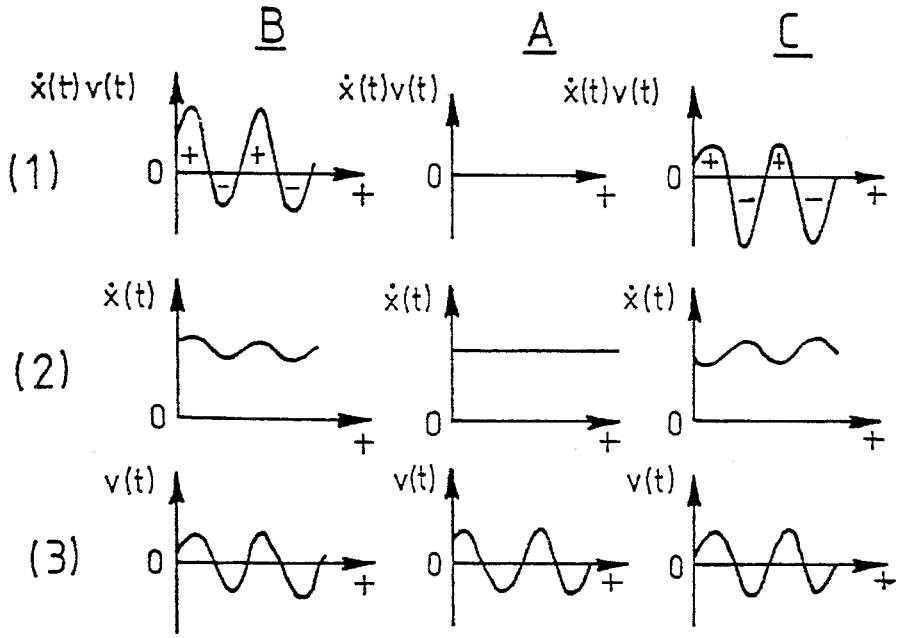

FIGS. 2*a* to 2*c* show control curves corresponding to the points A to C in FIG. 1. FIG. 2*a*$_1$ shows a situation in which the penetration rate is at its optimum, and the deviation value is 0 at this value of the penetration rate. FIG. $2a_2$ shows that the penetration rate $\dot{x}$ is constant, and FIG. $2a_3$ shows the shape of a deviation function V with respect to the set value $H_s$. As the integrated product of the deviation function V and the penetration rate $\dot{x}$ is constant, it indicates that the penetration rate is at its optimum, that is, as high as possible in the current conditions. FIG. 2b shows a control curve corresponding to the point B. FIG. $2b_1$, in turn, illustrates the product $\dot{x}^*$ V of the penetration rate and the deviation function. It can be seen from FIG. $2b_1$ that the change caused by the deviation function V in the penetration rate is positive as integrated, i.e. its area is positive, and so the area of curve portions on the positive side is greater than the area of curve portions on the negative side. As a result, it can be seen that the penetration rate changes as a function of the deviation in the same direction as the deviation in FIG. $2b_2$, while the deviation curve V in FIG. $2b_3$ has the same shape as the deviation curve in FIG. $2a_3$. As a result, the set value $H_s$ of the adjustable parameter is integrated similarly as described in connection with FIG. 1, that is, in a positive direction, until the set value $H_s$ is at the optimum point $H_{fopt}$. FIG. $2c_1$, in turn, shows a curve corresponding to the point C, in which the integration obtained on the basis of the product of the penetration rate $\dot{x}$ and the deviation function V, i.e., the area of the curve portions on the negative side of the curve is greater than the area of the curve portions on the positive side. Correspondingly, as shown in FIG. $2c_2$, the penetration rate $\dot{x}$ varies inversely and, as shown in FIG. $2c_3$, the deviation curve varies similarly as in FIG. $2a_3$. As a result, the integration of the set value $H_s$ takes place in a negative direction, that is, the set value $H_s$ decreases until it reaches the point A, that is, the penetration rate $H_{fopt}$.

Figure 3:
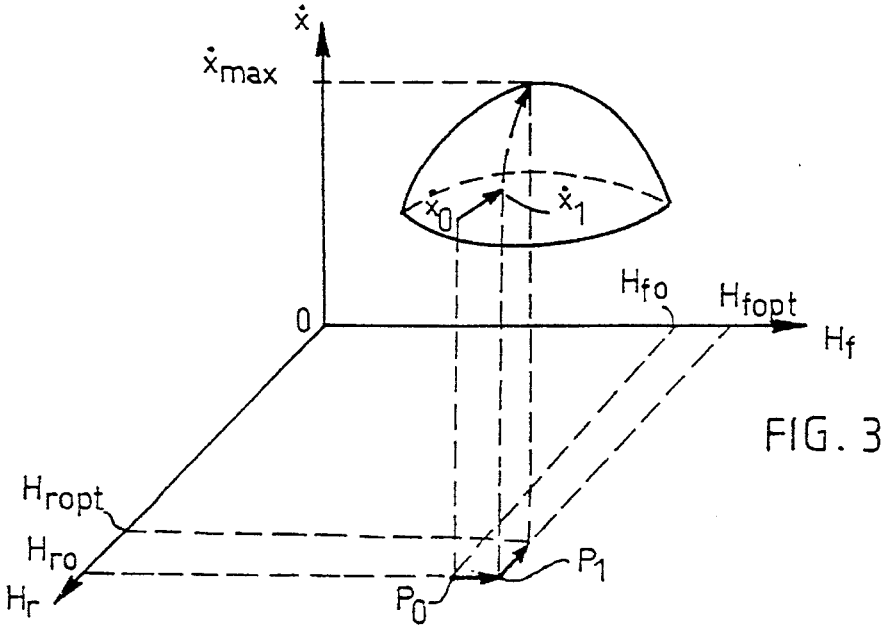
FIG. 3 is a graphic representation of the method according to the invention when realized with respect to two adjustable parameters.

FIG. 3 illustrates, similarly as FIGS. 1 and 2, the method according to the invention when applied with respect to two operating parameters $H_f$ and $H_r$. In this case, when certain conditions prevail, e.g. the percussion power is constant, the interdependent set values of the feed and the rotation rate form a convex surface with a predetermined maximum point, that is, $\dot{x}_{max}$ with respect to the penetration rate. Assume that the feed and the rotation are originally set to initial values $H_{f0}$ and $H_{r0}$, which give an operating point $P_0$. The point $P_0$ corresponds to a point $\dot{x}_0$ on the convex surface, which is the starting point. In this situation, the feed, for instance, is adjusted first by feed adjusting means, and a set value corresponding to the maximum penetration rate is determined for the feed at a predetermined fixed rotation rate by subjecting the set value of the feed force to a sinusoidal deviation and by adjusting the feed force as described above in connection with FIGS. 1 and 2. When the feed force is adjusted, its set value is shifted from the point $H_{f0}$ to a point $H_{fopt}$, so that the drill penetration rate is correspondingly shifted from the point $P_0$ to a point $P_1$, which corresponds to the maximum point of the penetration rate when the rotation rate is set to $H_{r0}$. This point corresponds to the point $\dot{x}_1$ on the convex surface representing the penetration rate. Thereafter the feed force is maintained at its set value $H_{fopt}$, and the rotation rate is adjusted according to the invention so that it decreases to a value $H_{ropt}$ while the penetration rate increases from the point $\dot{x}_1$ to a point $\dot{x}_{max}$, thus obtaining the maximum value of the penetration rate in this drilling situation in constant conditions. This procedure is continued by again adjusting the feed force and then again the rotation rate, so that the operation can be constantly kept at the point $\dot{x}_{max}$, and the adjustment only ensures that this is the case. An abrupt change in conditions affects the shape of the convex surface, and the position of the maximum point $\dot{x}_{max}$ of the penetration rate in the coordinate system changes accordingly. To restart the optimization of the drilling process, the adjustment is continued as described above. If it is assumed that the change takes place when the feed force is adjusted, the obtained set value for the feed will be fixed, and the rotation rate is adjusted by the method according to the invention by employing a sinusoidal deviation of the set value of the rotation rate, thus obtaining the maximum point $\dot{x}_{max}$ of the penetration rate at said set value of the feed force with respect to the rotation rate. Thereafter the rotation rate is again adjusted to a fixed value, and the feed force is again subjected to a sinusoidal deviation, and the maximum feed value is determined at this rotation rate. The set values are thus varied one after the other in such a way that the other is fixed and the other is deviated in accordance with a sinusoidal curve, and the deviation is integrated so that the maximum point $\dot{x}_{max}$ in the current conditions is achieved finally after a sufficient number of alternate deviations. A change in the drilling conditions, of course, affects the shape of the convex surface and thus the point $\dot{x}_{opt}$ or $\dot{x}_{max}$ is shifted. As the alternate deviation of the adjustable parameters is continued throughout the drilling process, the adjustment automatically adapts itself to changes in the conditions and adjusts the drilling process continuously so that the drilling takes place as close as possible to the maximum penetration rate, i.e., the point $\dot{x}_{max}$ on the surface, in the prevailing conditions.

Figure 4:
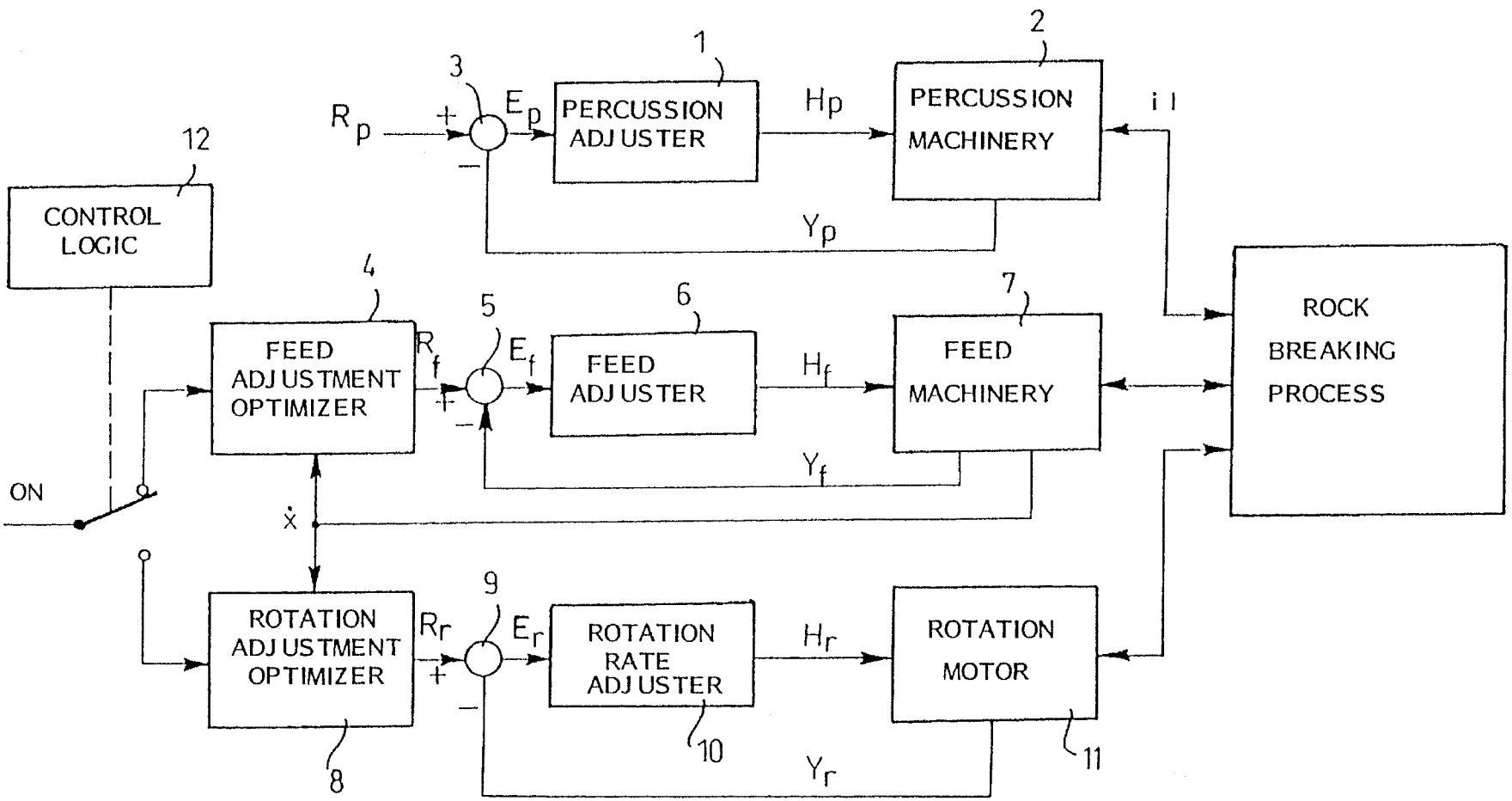
FIG. 4 is a graphic representation of an adjusting equipment for realizing the method according to the invention.

FIG. 4 shows an adjusting equipment for realizing the method according to the invention. The adjusting equipment comprises a percussion adjuster 1 forming a closed adjusting circuit and arranged to control a percussion machinery 2. The operation of the percussion machinery is measured and the results are applied to a comparator 3. A set value $R_p$ for the percussion is also applied to the comparator 3 from adjusting means, and the comparator 3 compares the set value of the percussion with the measured percussion value and controls the percussion adjuster 1 so that the actual value of the percussion is equal to the set value. The adjusting equipment further comprises a feed adjustment optimizer 4 which is connected to a comparator 5. The comparator 5 applies an adjustment value $E_f$ to a feed adjuster 6 which, in turn, is connected to control a feed apparatus 7. The feed apparatus 7 applies a measured value $Y_f$ to the comparator 5, which compares the set value of the feed adjuster and the measured value $Y_f$ and controls the feed adjuster 6 on the basis of the difference so that the feed rate is kept at a desired value. The adjusting equipment also comprises a rotation adjustment optimizer 8 having an output, i.e. a set value $R_r$ connected to a comparator 9. A difference value $E_r$ of the comparator 9, in turn, controls a rotation rate adjuster 10, which controls a rotation motor 11. A rotation rate value $Y_r$ is measured from the rotation motor 11 and applied back to the comparator 9, which determines the difference $E_r$ between the set value $R_r$ and the actual value $Y_r$. A penetration rate $\dot{x}$, the value of which is arranged to control both the feed adjustment optimizer 4 and the rotation adjustment optimizer 8, is measured from the feed apparatus. The adjusting means further comprise a controller i.e. a control logic 12, which connects deviation adjusters of the feed adjustment optimizer and the rotation adjustment optimizer alternately in operation so that a small sinusoidal deviation is caused to occur alternately in the set value $R_f$ and $R_r$ of one adjuster, while the other remains constant. Consequently, it is possible in the feed apparatus to measure variation in the feed rate, i.e. penetration rate, by means of a measuring device, and so the adjusting means of the optimizer circuits 4 and 8 can integrate the set valve on the basis of the variation in the penetration rate towards a set value corresponding to a higher penetration rate. This enables a rock breaking process 13 performed by the percussion machinery 2, the feed apparatus 7 and the rotation apparatus 11 to be optimized in accordance with the invention both when the conditions change and when they remain unchanged during the drilling process.

Figure 5:
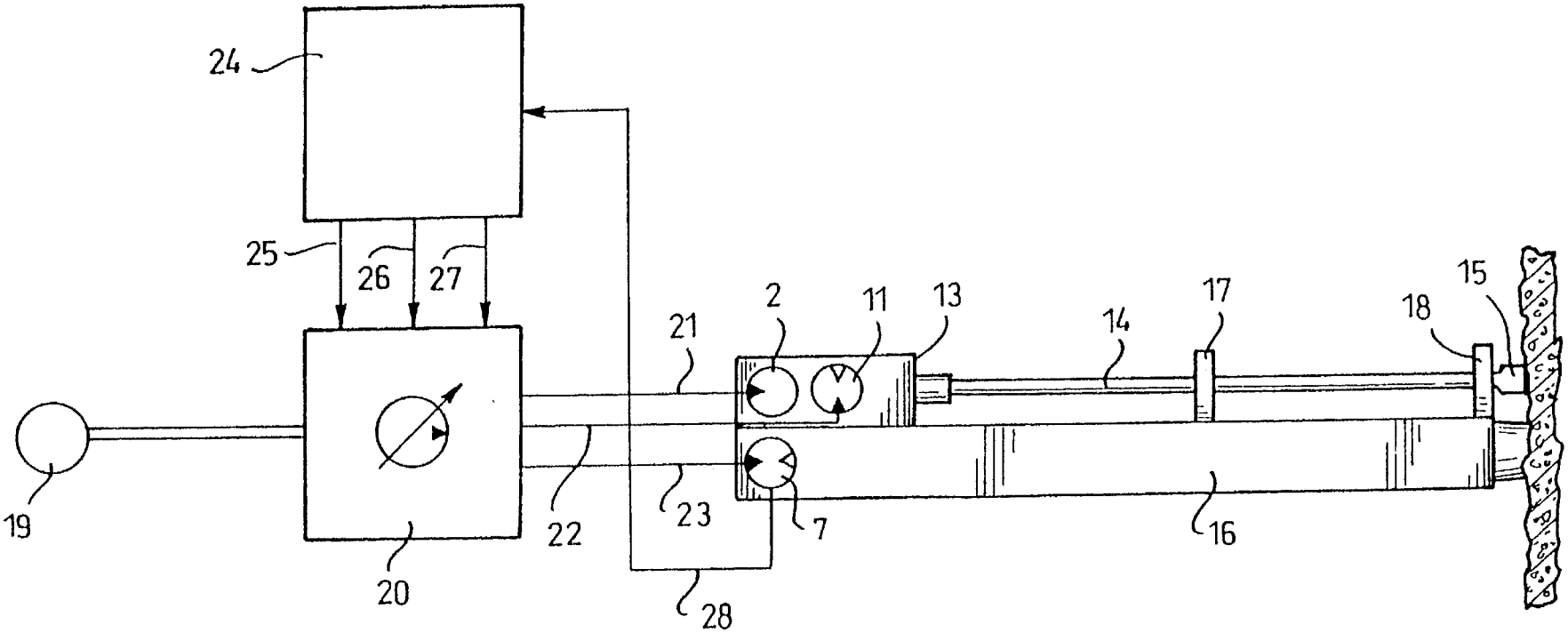
FIG. 5 illustrates schematically the connection of the adjusting equipment according to the invention to a rock drilling equipment for performing the drilling.

FIG. 5 shows schematically the connection of the adjusting equipment according to the invention to a conventional drilling equipment for performing a drilling process. FIG. 5 shows a drilling machine 13 to which a drill rod 14 is attached. A drill bit 15 is attached to the end of the drill rod. The drilling machine 13 is mounted on a feed beam 16 longitudinally movably with respect to it. Drill rod centralizers 17 and 18 are also mounted on the feed beam so as to support the drill rod during the drilling; they are well known and therefore will not be described in greater detail herein. The drilling equipment further comprises a motor 19, which rotates a pump of a hydraulic power unit 20, or if there are several pumps, as is well known, all of the pumps, for supplying hydraulic fluid through conduits 21 to 23 into the percussion machinery 2, the rotation motor 11 and the feed motor 7, of which the last-mentioned forms part of the feed system. The drilling machine 13 is displaced on the feed beam forwards, that is, towards the rock during the drilling by means of the feed motor 7. The connection of the feed motor 7 and the power transmission to the drilling machine 13 are known per se and obvious to one skilled in the art and therefore will not be described in more detail. The drilling equipment further comprises a control unit 24, which contains e.g. the adjusting means and devices shown in FIG. 4, by means of which the drilling process is adjusted. The control unit 24 is connected by means of control conduits 25 to 27 to the hydraulic power unit so that each conduit controls a specific operation as shown in FIG. 4 for carrying out the method. Accordingly, for instance, the conduit 25 is arranged to control the percussion power to the percussion machinery 2, the conduit 26 is arranged to adjust the amount of hydraulic fluid to be supplied to the rotation motor 11 so as to adjust the rotation rate, and the conduit 27 is arranged to adjust the amount of hydraulic fluid to be supplied to the feed motor 7. Further, a control signal 28 is applied from the feed motor 7 to the control unit 24 in order to indicate the rate of travel of the drilling machine 13 with respect to the feed beam 16, that is, the drill penetration rate $\dot{x}$, on the basis of which the optimization and adjustment of the drilling process are carried out as described above.

The invention has been described and shown in the description above and the attached drawings only by way of example, and it is in no way restricted to this example. Drilling can be optimized in various ways, of which the optimization of the penetration rate is one of the most important in many cases. Another well known alternative is to calculate the cost of penetration per length unit while allowing for the other parameters and then adjust the drilling process so that the cost is minimized. In practice, however, the maximum penetration rate often corresponds to the cost minimum on a certain percussion power level.

I claim:

1. A method of optimizing rock drilling wherein a penetration rate of a drill bit of a drilling machine into a rock is measured and at least first and second operating parameters of a drilling equipment are adjusted to maximize the penetration rate, comprising the steps of:

causing a substantially continuous deviation to occur symmetrically on both sides of a set value of said first operating parameter to be adjusted, while maintaining said second parameter constant;

measuring a change in the penetration rate caused by said substantially continuous deviation on both sides of said set value of said first operating parameter to be adjusted; and when the measured change caused by the deviation in the penetration rate is different on opposite sides of said set value of said first operating parameter, adjusting the set value of said first operating parameter on the basis of said measurement in a direction in which the penetration rate increases.

2. A method according to claim 1 including:

when a maximum value of the penetration rate is substantially achieved by adjusting said first operating parameter, causing a continuous deviation to occur symmetrically on both sides of a set value of said second operating parameter to be adjusted while maintaining said first parameter constant;

measuring a change in the penetration rate caused by the deviation of said second operating parameter; and when the change caused by the deviation in the penetration rate of said second operating parameter is different on opposite sides of said set value thereof, adjusting the set value of said second operating parameter on the basis of said measurement in a direction in which the penetration rate increases.

3. A method according to claim 1 wherein the step of deviating includes deviating the set value of the first operating parameter as a sinusoidal curve.

4. A method according to claim 2 wherein the steps of deviating include deviating the set values of said first and second operating parameters as sinusoidal curves.

5. A method according to claim 2 wherein said first and second operating parameters to be adjusted are the feed force of the drilling machine and the rotation rate of the drill bit, respectively, said drilling machine including percussion machinery, and maintaining the percussion power of the percussion machinery substantially constant during said deviations.

6. A method according to claim 2 including providing a set value for each of said first and second operating parameters, combining with the set value of each parameter a deviation curve during adjustment of each parameter to deviate said set value, adding a change caused by the deviation in the penetration rate to the set value such that when the set value deviates from a maximum value of the penetration rate, the set value shifts automatically towards a set value corresponding to the maximum penetration rate, while maintaining the other operating parameter substantially constant.

7. Rock drilling apparatus for maximizing the rate of penetration of a drill bit into rock comprising:

control devices for providing set values of at least two operational parameters for the drilling apparatus;

means for measuring a penetration rate of the drill bit into the rock;

said control devices including automatically operated adjusting means for deviating one of said two parameters at a time from and on opposite sides of a set value; and a measuring device to measure variation in the penetration rate resulting from a deviation of said one parameter on opposite sides of said set value;

said control device further including means for shifting the set value of said one parameter in response to the measured variation and in a direction in which the penetration rate increases;

said adjusting means being operable to change an operating parameter being deviated to another operating parameter to be deviated when the set value of the operating parameter being adjusted is adjusted to a value substantially corresponding to a maximum penetration rate of the drill bit.

8. Rock drilling apparatus according to claim 7 wherein said adjusting means comprises a first control means for sequentially deviating the set values for a feed force and a rotation rate of the drill bit.

9. Rock drilling apparatus according to claim 8 wherein said adjusting means comprises a second separate control means for adjusting the set value of both the feed force and the rotation rate, said penetration rate measuring means being arranged to control both said first and second control means, and said adjusting means further including a separate changeover control which alternately switches from one to another of said first and second control means into deviation operation for adjusting the respective set values.

* * * * *